US005645025A

United States Patent [19]

Caya et al.

[11] Patent Number: 5,645,025

[45] Date of Patent: Jul. 8, 1997

[54] INTERNAL COMBUSTION ENGINE

[75] Inventors: Donald M. Caya, Wales; Thomas L. Barnhardt, Hartford, both of Wis.

[73] Assignee: Briggs & Stratton Corporation, Wauwatosa, Wis.

[21] Appl. No.: 625,393

[22] Filed: Mar. 27, 1996

[51] Int. Cl.[6] ..... F01L 1/18; F01L 1/20

[52] U.S. Cl. ..... 123/90.42; 123/90.41; 123/90.45; 123/90.38; 123/193.5

[58] Field of Search ..... 123/90.38, 90.39, 123/90.41, 90.42, 90.45, 90.46, 193.5; 74/519, 559

[56] References Cited

U.S. PATENT DOCUMENTS

| | | | |
|---|---|---|---|
| 1,442,698 | 1/1923 | Page | 123/90.34 |
| 1,503,463 | 8/1924 | Amos et al. | 123/90.45 |
| 1,699,659 | 1/1929 | Fagan | 74/519 |
| 1,979,348 | 11/1934 | Russell | 123/90.45 |
| 2,864,351 | 12/1958 | Leach | 123/90.41 |
| 2,926,645 | 3/1960 | Guarraia | 74/559 |
| 3,066,659 | 12/1962 | Colton | 123/90.16 |
| 3,082,755 | 3/1963 | Gropp | 74/559 |
| 3,301,238 | 1/1967 | Hanley | 123/90.41 |
| 3,335,709 | 8/1967 | Mikucki | 123/90.41 |
| 3,563,215 | 2/1971 | Ross | 123/90.42 |
| 3,841,280 | 10/1974 | Lussier | 123/90.39 |
| 3,880,127 | 4/1975 | Abell, Jr. | 123/90.35 |
| 3,942,490 | 3/1976 | Scott | 123/90.41 |
| 3,986,485 | 10/1976 | Weaver | 123/90.42 |
| 4,164,927 | 8/1979 | Congram et al. | 123/90.38 |
| 4,393,820 | 7/1983 | Maki et al. | 123/90.41 |
| 4,495,903 | 1/1985 | Asano | 123/90.38 |
| 4,653,441 | 3/1987 | Belsanti | 123/90.39 |
| 5,207,191 | 5/1993 | Pryba et al. | 123/90.39 |
| 5,329,891 | 7/1994 | Murphy et al. | 123/90.39 |

OTHER PUBLICATIONS

Two photos of the same Ford Motor Company engine, first sold at least as early as 1993.

*Primary Examiner*—Weilun Lo

*Attorney, Agent, or Firm*—Michael, Best & Friedrich

[57] ABSTRACT

The internal combustion engine includes a cast cylinder head having as-cast alignment ribs that align a squared-off fulcrum in the rocker assembly. The rocker arm also has two substantially flat surfaces that engage the planar sides of the fulcrum to minimize lateral movement of the rocker arm. The fulcrum is received between the cast alignment ribs. The ribs are biased from a major axis to insure proper fulcrum alignment during assembly without the use of a jig.

17 Claims, 5 Drawing Sheets

INTERNAL COMBUSTION ENGINE

BACKGROUND OF THE INVENTION

This invention relates to internal combustion engines. More particularly, this invention relates to cylinder heads and rocker arm assemblies for internal combustion engines.

Internal combustion engines often have a fulcrum rocker assembly for operating the intake and exhaust valves. The push rod which engages the rocker assembly is typically held in alignment by a push rod guide plate. The guide plate is required because in typical rocker arm assemblies, the bearing surface on the rocker arm which engages the fulcrum bearing surface is semi-spherical in shape, so that the rocker arm may turn laterally. The push rod guide plate tends to prevent such lateral rotation, but at increased expense.

It is known to prevent rotation of the fulcrum by providing a squared-off fulcrum block portion having at least two substantially parallel sides. These sides may be retained by a retainer, which is fastened to the cylinder head. In other prior art engines, the fulcrum block is retained by a pair of spaced alignment ribs integrally formed with the cylinder head. These alignment ribs are created by machining the cylinder head after the cylinder head has been cast; a slot or groove is formed in the pedestal portion of the cylinder head by machining, with the ribs being spaced on opposite sides of the groove. Of course, this process is relatively expensive since a machining step is required to form the ribs.

In fulcrum rocker assemblies, there is a small gap or lash between the end of the push rod and the rocker arm. If the lash is too large, the engine will tend to clatter and either the push rod or the rocker arm may wear prematurely. Therefore, it is desirable to adjust the amount of lash so that the lash stays within acceptable limits.

Typical prior art engines use self-adjusting hydraulic lash adjusters. However, these hydraulic lash adjusters are relatively complex and expensive to manufacture and assemble.

Therefore, it is desirable to reduce the cost of an internal combustion engine by both reducing the number of components and the number of machining and assembly steps.

SUMMARY OF THE INVENTION

An internal combustion engine is provided which is manufactured with fewer components and fewer machining steps to reduce the overall cost of the engine.

The engine according to the present invention comprises a cylinder having a bore therein, a cast cylinder head disposed adjacent to an end of the cylinder, first and second spaced, cast ribs integrally formed with the cast cylinder head without machining, and a valve operating apparatus that operates both the intake valve and the exhaust valve of the engine. In a preferred embodiment, the valve operating apparatus includes a rotatable cam shaft having at least one cam thereon, a push rod that moves in response to the cam and a rocker arm that is pivoted in response to the movement of the push rod. The rocker arm includes a cavity, defined by a bearing surface and by a pair of opposed substantially flat surfaces on opposite sides of the bearing surface.

The valve operating apparatus also includes a fulcrum that is partially disposed in an aperture in the rocker arm, the fulcrum having a pair of substantially flat surfaces that are received between the pair of flat rocker surfaces. Means are also provided for substantially immobilizing the fulcrum, such as a stud that is received in an aperture in the fulcrum as well as in a cylinder head aperture. In one embodiment, the stud may be fastened to the cylinder head cover.

The present invention preferably includes a mechanical lash adjuster which is interconnected with the rocker arm. The lash adjuster preferably comprises an aperture in the rocker arm, an adjustment screw disposed in the aperture that engages the push rod, a means for changing the position of the adjustment screw, and a means for locking the position of the adjustment screw.

The engine according to the present invention includes a unique cast cylinder head which is less expensive to manufacture and machine compared to typical prior art cylinder heads. The cast cylinder head according to the present invention comprises a body member, a first aperture in the body member that receives a valve stem from either an intake or an exhaust valve, a cast pedestal that is integrally formed with the body member and that supports a rocker fulcrum, a second aperture in the pedestal that receives a rocker stud to immobilize the fulcrum, and first and second spaced, cast ribs integrally formed with the pedestal without machining, the fulcrum being disposed between the ribs. In a preferred embodiment, the cast cylinder head includes a third aperture that receives a second valve stem, a second cast pedestal integrally formed with the body member that supports a second rocker fulcrum, a fourth aperture in the second pedestal that is used to immobilize the second fulcrum, and third and fourth spaced, cast ribs integrally formed with the second pedestal without machining, with the second fulcrum being disposed between the third and fourth ribs.

Also in a preferred embodiment, the ribs are positioned such that the first rib forms an angle of between 0.5 to 5 degrees with a line parallel to a first line intersecting the first and second apertures. The second rib is substantially parallel to the first rib.

In an alternate embodiment, the first rib forms an angle of between 0.5 to 5 degrees with a line which is normal to the first line intersecting the first and second apertures. In any event, the ribs are either substantially parallel to or substantially normal to a longitudinal axis of their respective rocker arms, although ribs from different pairs are not parallel to each other.

These orientation of the ribs enable the rocker fulcrum block to be properly positioned between the ribs after the rocker stud is torqued, without requiring a jig to hold the fulcrum in place during assembly.

The present invention eliminates additional components which have been used to retain the fulcrum in place, and eliminates any machining step previously required to form the alignment ribs. The present invention also eliminates the need for a push rod guide plate.

These and other features and advantages of the present invention will be apparent to those skilled in the art from the following detailed description of the preferred embodiments and the drawings, in which:

BRIEF DESCRIPTION OF THE DRAWINGS

FIG. 3 is a side cross-sectional view of the cylinder head depicting the mechanical lash adjuster.

DETAILED DESCRIPTION OF THE INVENTION

Figure 1:
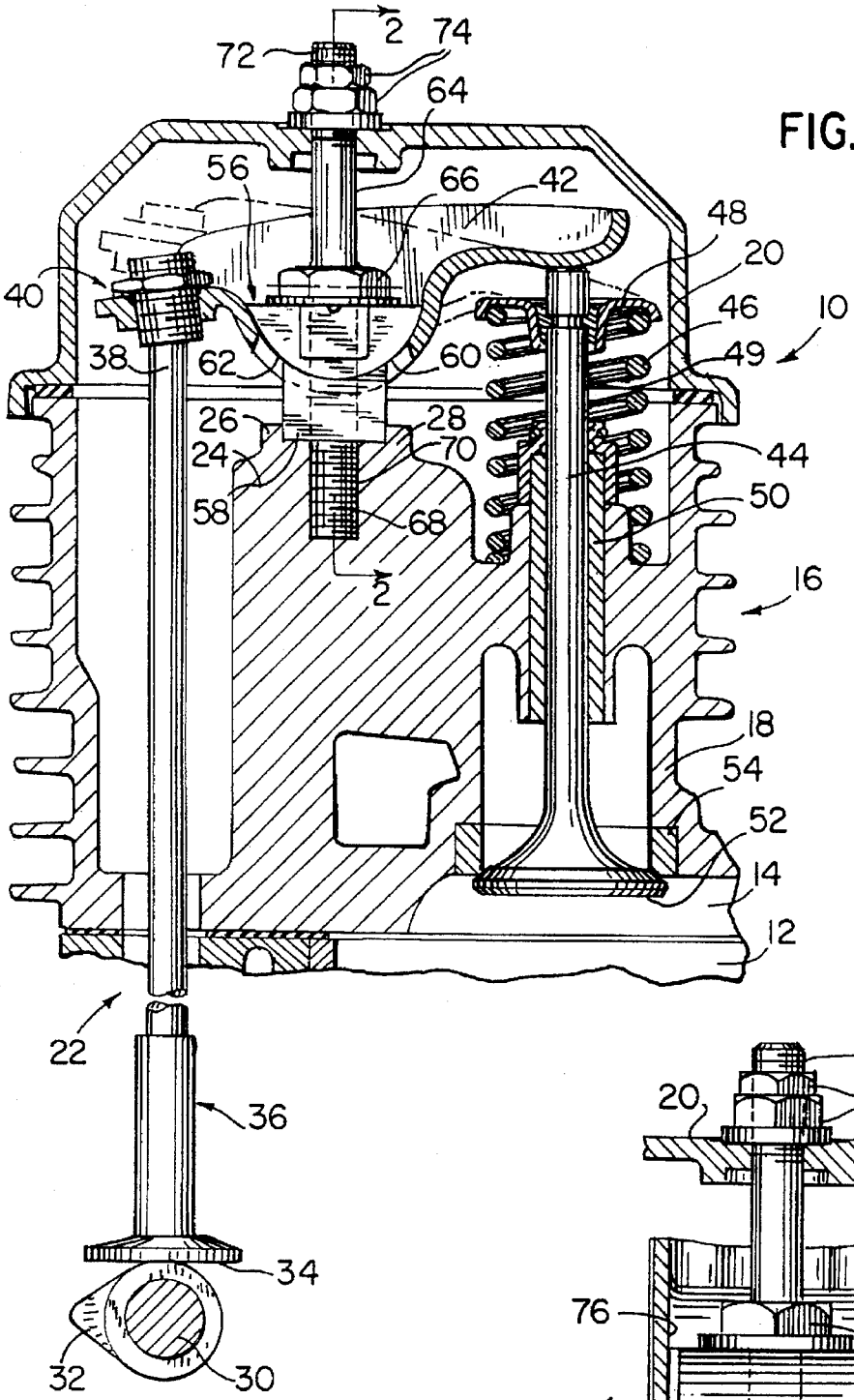
FIG. 1 is a side cross-sectional view of an engine incorporating the present invention.

FIG. 1 is a side cross-sectional view of an engine incorporating the present invention. In FIG. 1, engine 10 includes a cylinder 12, a combustion chamber 14, a cylinder head 16 having a body member 18, a cylinder head cover 20, and a valve operating mechanism 22.

The cylinder head is cast, and includes an as-cast pedestal 24, and as-cast alignment ribs 26 and 28. As more fully discussed below, the cylinder head also includes a second pedestal having a second pair of as-cast, integrally formed alignment ribs. The cylinder head is preferably cast from an aluminum alloy, although other materials may be used. The pedestals and the alignment ribs will be more fully discussed in connection with FIGS. 2 through 3 and 6 through 10.

Valve operating mechanisms 22 includes a cam shaft 30 having at least one cam lobe 32 affixed thereto. Cam lobe 32 engages a tappet 34 of a push rod 36. An opposite end 38 of push rod 36 engages a valve lash adjuster 40 that is interconnected with a rocker arm 42.

The opposite end of rocker arm 42 engages a valve stem 44 of an intake or exhaust valve. A return spring 46 returns valve 44 to its proper position after the valve has been actuated by the valve operating assembly. A retainer 48 retains the spring in its proper position. Valve stem 44 is received in a cylinder head aperture 49, and is guided by a valve guide insert 50. The valve has a valve head 52 that is lifted off of its valve seat insert 54 when the valve is opened.

The valve operating assembly also includes a fulcrum 56 having a block portion 58 that is shaped substantially like a regular prism. Two opposed, substantially flat surfaces of block portion 58 are disposed between ribs 26 and 28 and are substantially aligned therewith. Fulcrum 56 also includes a bearing surface 60 which is substantially cylindrical. Surface 60 engages a corresponding bearing surface 62 on rocker arm 42.

Fulcrum 56 is immobilized by a rocker stud 64 having an integrally-formed hexagonal nut 66. A first end 68 of stud 64 is threaded and is received in an aperture 70 in the cylinder head. An opposite second end 72 of stud is also threaded, and is fastened to head cover 20 by one or more fasteners 74.

The operation of the valve operating mechanism is as follows: Upon rotation of crankshaft 30, cam lobe 32 engages tappet surface 34, causing push rod 36 to pivot rocker arm 42 about fulcrum 56. As a result, rocker arm 42 applies a downward force on valve stem 44, thereby lifting the valve head 52 off of valve seat 54. After further rotation of cam shaft 30, return spring 46 returns valve stem 44 and valve head 52 to their original positions.

The other engine valve is operated by a valve operating assembly that is substantially identical to the valve operating assembly discussed above.

Figure 2:
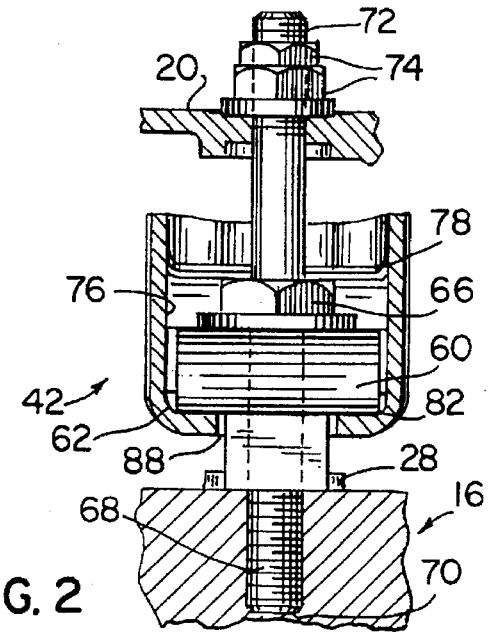
FIG. 2 is a side cross-sectional view of the fulcrum block-rocker assembly, taken along line 2—2 of FIG. 1.
Figure 4:
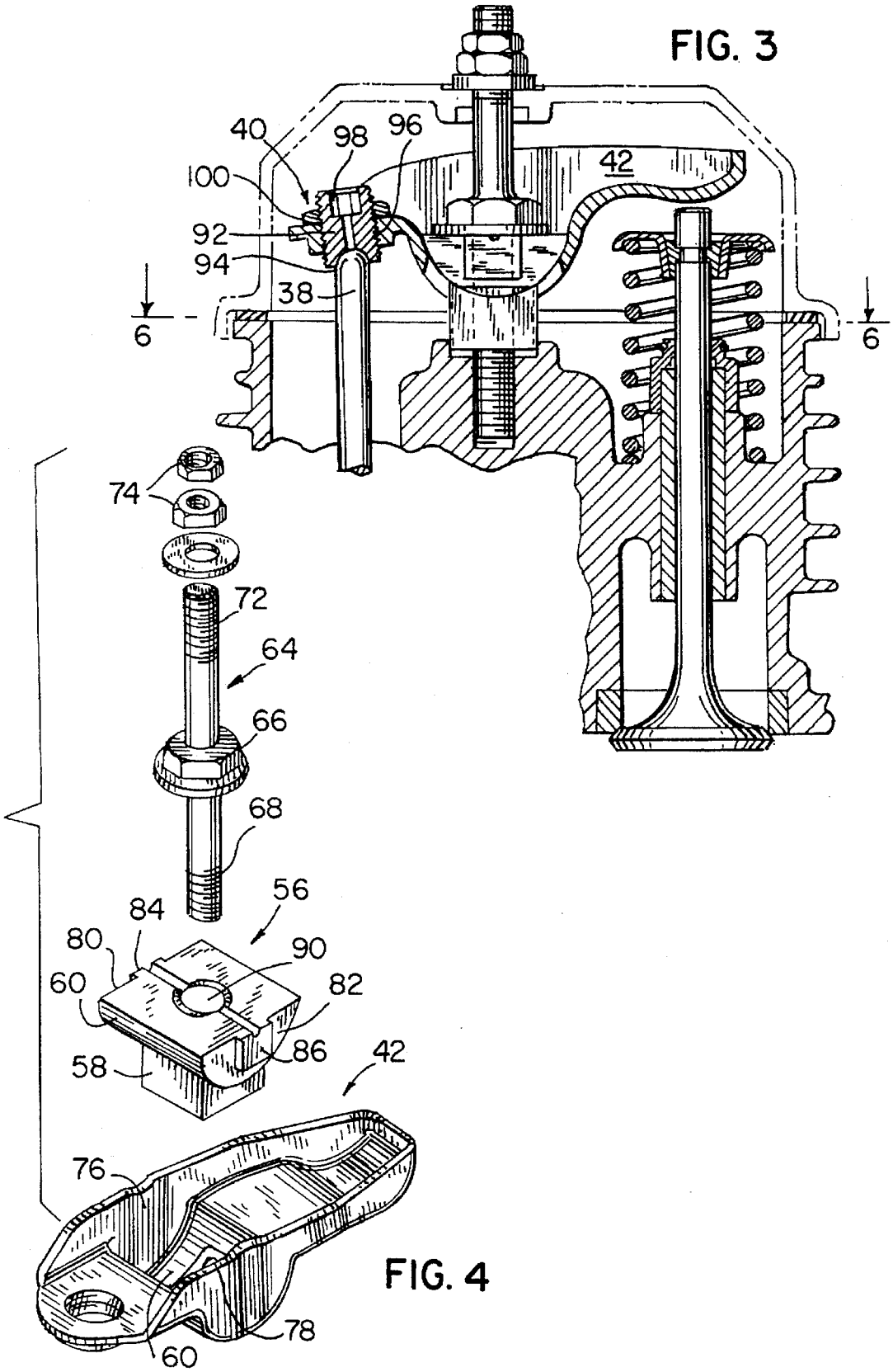
FIG. 4 is an exploded view of the fulcrum block-rocker assembly.

The rocker arm-fulcrum assembly is best understood in connection with FIGS. 2 and 4. In FIGS. 2 and 4, rocker arm 42 has two opposed sides 76 and 78 which engage sides 80 and 82 respectively of fulcrum 56. Fulcrum sides 80 and 82 may have respective tabs 84 and 86 which reduce the play between the stamped rocker arm and the fulcrum block.

As best shown in FIG. 2, rocker arm 42 has an aperture 88 that receives block portion 58 of fulcrum 56. Fulcrum 56 also includes a fulcrum aperture 90 which in turn receives threaded portion 68 of rocker stud 64. As best shown in FIG. 2, sides 80 and 82 of fulcrum 56 engage sides 76 and 78 respectively of rocker arm 42. This arrangement, in combination with the fulcrum block-alignment rib assembly, minimizes lateral movement or turning of rocker arm 42, thereby eliminating the need for a separate push rod guide plate.

Referring again to FIGS. 2 and 4, and as also shown in FIGS. 1 and 3, rocker stud 64 is fastened to head cover 20. This arrangement tends to lessen the loosening of the stud over time due to engine vibration.

The present invention also includes a mechanical lash adjuster which is substantially less complex and less expensive when compared to the hydraulic lash adjusters typically used in prior art engines.

Figure 5:
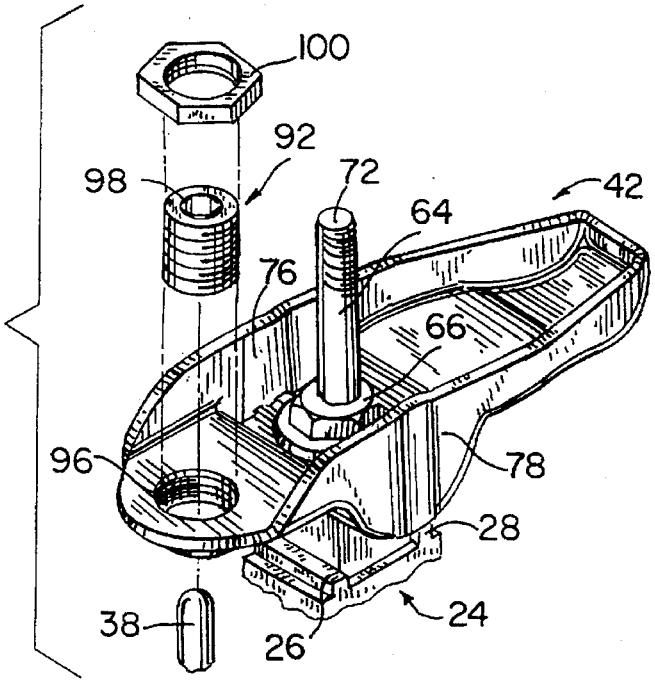
FIG. 5 is an exploded view of the mechanical lash adjuster assembly.

The mechanical lash adjuster according to the present invention is best understood by reference to FIGS. 1, 3 and 5. In FIGS. 1, 3 and 5, lash adjuster 40 includes an externally-threaded adjustment screw 92 having a recess 94 that receives push rod end 38. Adjustment screw 92 is received in a threaded aperture 96 of rocker arm 42. Adjustment screw 92 also includes a hexagonal insert 98 adapted to receive a tool used to rotate and position the adjustment screw. The positioning of the adjustment screw is locked by a locking jam nut 100. Adjustment screw 92 is rotated until the desired amount of lash is achieved, and is locked in position by the jam nut.

The present invention also includes as-cast ribs, integrally formed with the cast cylinder head pedestal, that are used to align fulcrum 56, and more particularly fulcrum block portion 58, with respect to rocker arm 42 and with respect to the push rod and the valve stem. Since the alignment ribs are as-cast, the tolerances between fulcrum block portion 58 and the ribs are not as exact as the tolerances would be in a prior art cylinder head having ribs formed by machining or by a separate part. As a result of the greater tolerances, fulcrum block portion 58 tends to rotate in a clockwise direction while stud 64 is being torqued during the assembly process. One way to prevent such rotation would be to use a jig to keep the fulcrum block in its proper position. However, the orientations of the ribs as described below avoid the need for a jig.

Figure 6:
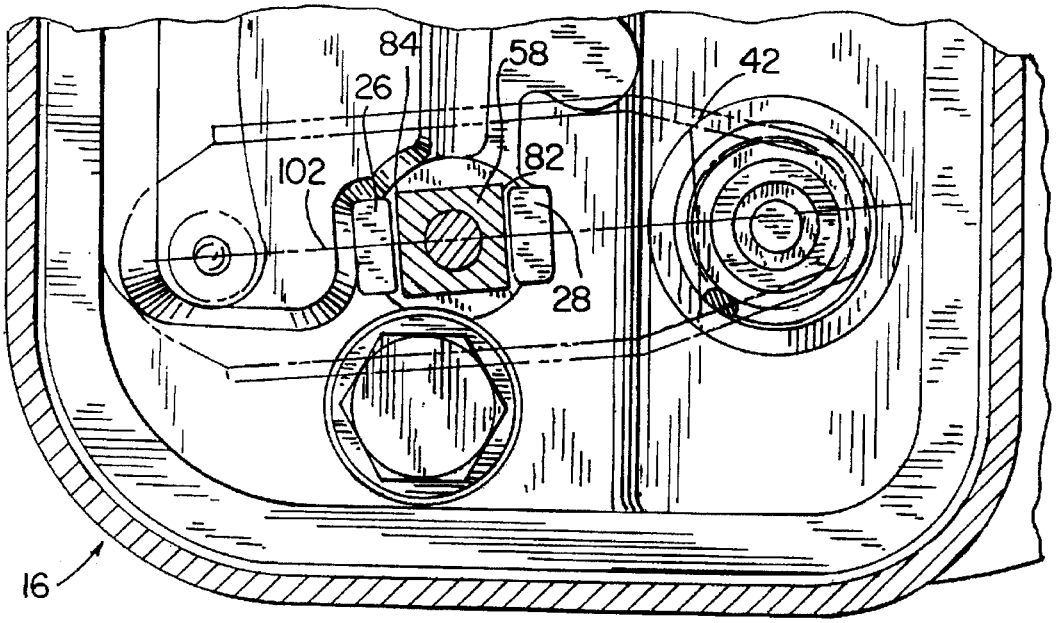
FIG. 6 is a top view of a portion of the cylinder head, depicting the fulcrum block side surfaces being substantially normal to the longitudinal axis of the rocker arm and substantially parallel to the ribs.

FIG. 6 depicts fulcrum block 56 with block sides 82 and 84 being substantially parallel to ribs 26 and 28 respectively, and substantially normal to a longitudinal axis 102 of rocker arm 42. Axis 102 is substantially parallel to a line between aperture 70 and aperture 49 (FIG. 1).

Figure 7:
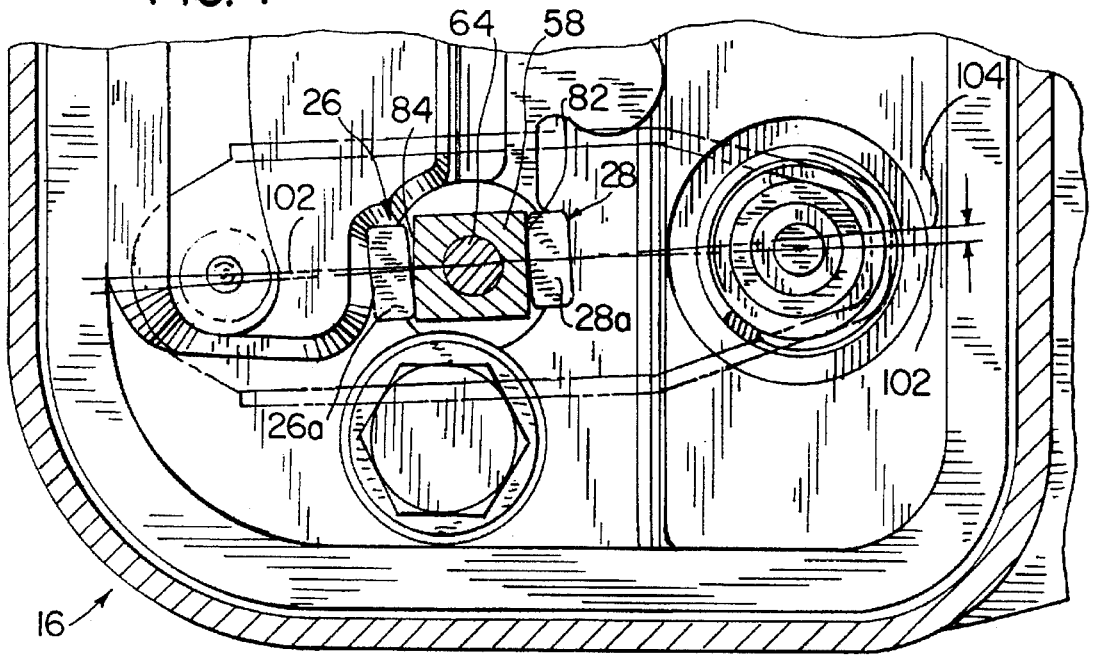
FIG. 7 depicts the cylinder head assembly of FIG. 6 after the fulcrum block has been torqued in a clockwise direction during assembly.

FIG. 7 depicts the position of fulcrum block 58 after stud 64 has been torqued in the clockwise direction. In FIG. 7, line 104 connects midpoints of the upper surfaces 26a and 28a of ribs 26 and 28 respectively. As depicted in FIG. 7, fulcrum sides 82 and 84 are no longer normal to line 104 and are no longer parallel to ribs 26 and 28, but may actually touch or nearly touch ribs 26 and 28. As shown in FIG. 7, line 104 is not collinear with longitudinal axis 102.

Figure 8:
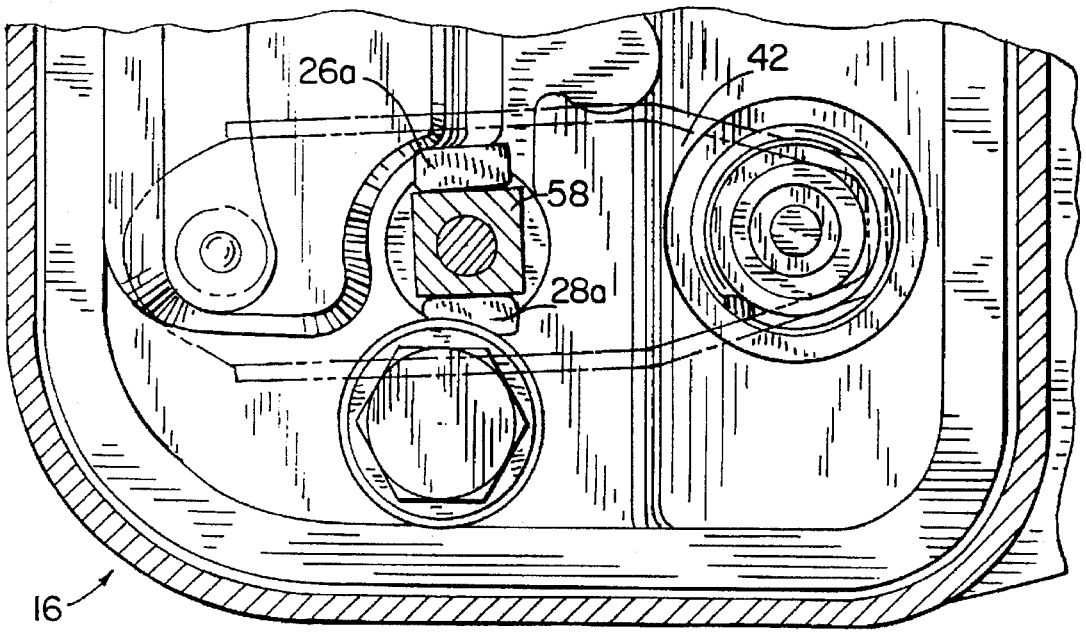
FIG. 8 is a top view of a portion of the cylinder head assembly depicting a second orientation of the alignment ribs after the fulcrum block has been torqued in a clockwise direction.

As depicted in FIG. 8, a similar situation occurs when the alignment ribs 26*a* and 28*a* are oriented 90 degrees from the respective positions of ribs 26 and 28 in FIG. 7. As shown in FIG. 8, fulcrum block 58 may touch or nearly touch ribs 26*a* and 28*a* after the rocker stud is torqued in the clockwise direction.

To insure that the fulcrum block remains properly positioned despite the relatively large tolerances between the as-cast ribs and the fulcrum block, the ribs are positioned in a unique orientation in the present invention. This orientation will be discussed in connection with FIGS. 9 and 10.

Figure 9:
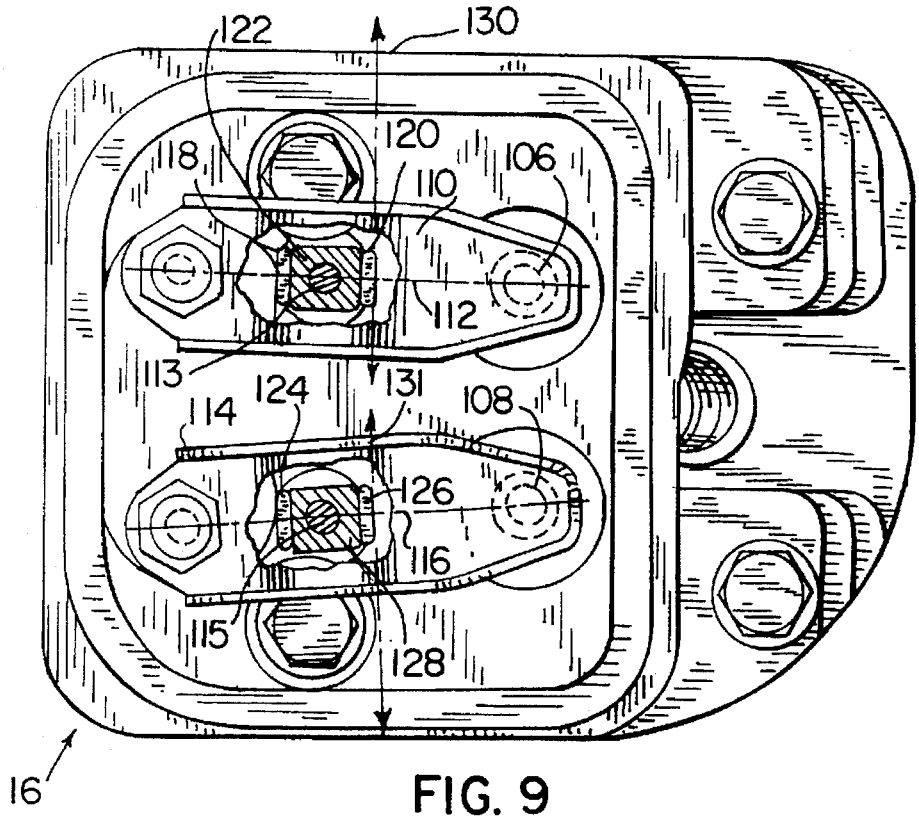
FIG. 9 is a top view of the cylinder head according to the first embodiment.

FIG. 9 depicts the cylinder head and rocker assembly according to a first embodiment of the present invention. In FIG. 9, a line 112 intersects both a cylinder head aperture 106 that receives a first valve stem and a cylinder head aperture in the pedestal, the latter aperture receiving a rocker stud 113. A first rocker arm 110 has a longitudinal axis that is substantially parallel to line 112 after stud 113 has been torqued. Second rocker arm 114 has a longitudinal axis that is substantially parallel to a line 116 after a second rocker stud 115 has been torqued. Line 116 connects the cylinder head aperture which receives stud 115 with a cylinder head aperture 108 that receives a second valve stem. Note that rocker arms 110 and 114 are not parallel to each other, and their respective longitudinal axes are not parallel to each other. This configuration of the rocker arms is used because additional space is required between the cam lobes for the respective rocker arms, and so that the respective valve tappets of the push rods do not interfere with each other when they engage their respective cam lobes.

In FIG. 9, cylinder head 16 has two as-cast alignment ribs 118 and 120, with a first fulcrum 122 being disposed therebetween. Cylinder head 16 also includes two as-cast alignment ribs 124 and 126, with a fulcrum 128 being disposed therebetween. Rib 120 preferably forms an angle of about 0.5 to 5 degrees with respect to a line 130. Line 130 is normal to line 112. In a preferred embodiment, the angle between rib 120 and line 130 is between 1.5 to 2.5 degrees, with 2 degrees being particularly desirable. Rib 118 is substantially parallel to rib 120.

Likewise, rib 126 makes an angle of about 0.5 to 5 degrees with respect to line 131, with the preferred range being between 1.5 to 2.5 degrees, and 2 degrees being optimal. Line 131 is normal to line 116. Rib 124 is substantially parallel to rib 126.

Figure 10:
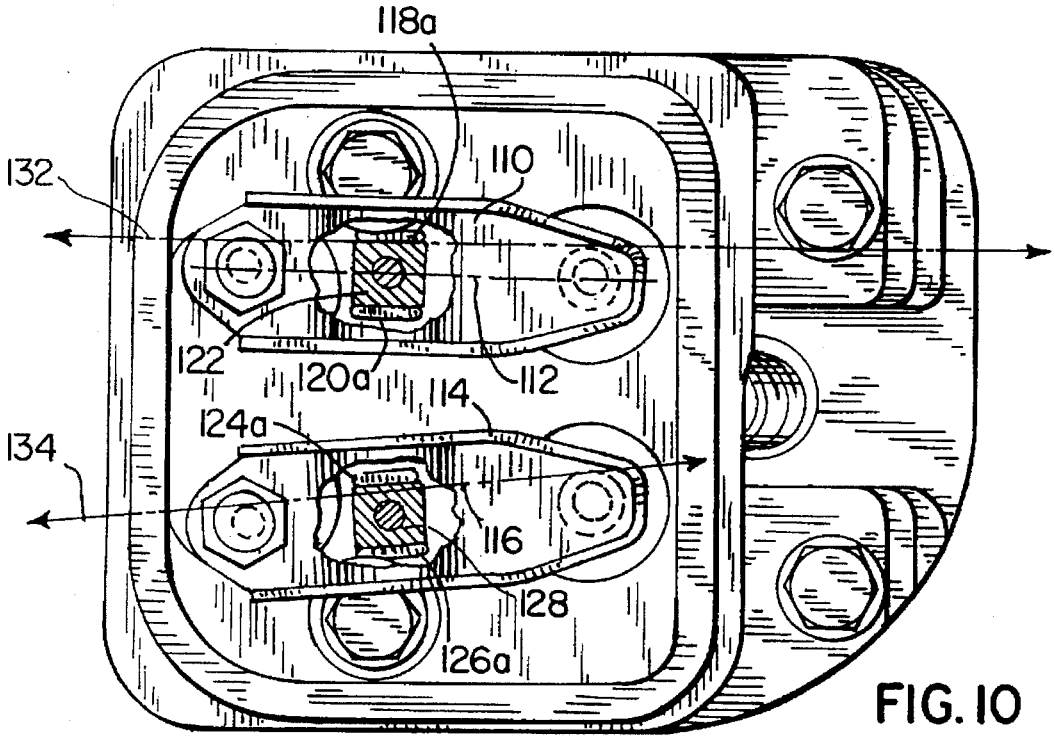
FIG. 10 is a top view of the cylinder head according to the second embodiment.

In the second embodiment depicted in FIG. 10, rib 118*a* forms an angle of between 0.5 to 5 degrees with respect to a line 132. Line 132 is parallel to line 112. Rib 120*a* is substantially parallel to rib 118*a*. Rib 118*a* preferably forms an angle of about 2 degrees with respect to line 132, with a tolerance of plus or minus 0.5 degrees. Likewise, rib 124*a* forms an angle of about 0.5 to 5 degrees with respect to a line 134. Line 134 is parallel to line 116. The optimal angle is about 2 degrees, with a tolerance of plus or minus 0.5 degrees. Rib 126*a* is substantially parallel to rib 124*a*.

The ribs as depicted and described in the present invention are substantially straight and have substantially planar surfaces. Also, the corresponding surfaces on fulcrum block portion 58 have been assumed to be substantially planar. However, it would be apparent to those skilled in the art that other shapes may be used without departing from the spirit and scope of the present invention. Regardless of the shape of the ribs, the angle between the ribs and the lines as depicted and described herein are assumed to have been taken between the longitudinal or main axis of the rib and the respective line.

While several embodiments of the present invention have been shown and described, alternate embodiments would be apparent to those skilled in the art and are within the intended scope of the present invention. Therefore, the invention is to be limited only by the following claims.

We claim:

1. A cast cylinder head for an internal combustion engine, comprising:

a body member;

a first aperture in said body member that receives a valve stem;

a cast pedestal, integral with said body member, that supports a rocker fulcrum;

a second aperture, in said pedestal, that is used to immobilize said fulcrum; and first and second spaced cast ribs integrally formed with said pedestal without machining, said fulcrum being disposed between said ribs;

wherein said first and second aperture are intersected by first line, and wherein said first rib forms an angle of between 0.5 to 5 degrees with a second line that is at least one of parallel and normal to said first line.

2. The cylinder head of claim 1, wherein said second rib is substantially parallel to said first rib.

3. The cast cylinder head of claim 1, further comprising:

a third aperture in said body member that receives a second valve stem;

a second cast pedestal, integral with said body member, that supports a second rocker fulcrum;

a fourth aperture in said second pedestal that is used to immobilize said second fulcrum; and third and fourth spaced cast ribs integrally formed with said second pedestal without machining, said second fulcrum being disposed between said third and fourth ribs.

4. The cylinder head of claim 3, wherein said third and fourth apertures are intersected by a first line, and wherein said first and third ribs each form an angle of between 0.5 to 5.0 degrees with a second line parallel to said first line.

5. The cylinder head of claim 4, wherein said first and third ribs are non-parallel to each other.

6. The cylinder head of claim 5, wherein said second rib is substantially parallel to said first rib, and wherein said fourth rib is substantially parallel to said third rib.

7. The cylinder head of claim 3, wherein said third and fourth apertures are intersected by a first line, and wherein said first and third ribs each form an angle of between 0.5 to 5.0 degrees with a second line normal to said first line.

8. The cylinder head of claim 7, wherein said first and third ribs are non-parallel to each other.

9. The cylinder head of claim 7, wherein said second rib is substantially parallel to said first rib, and wherein said fourth rib is substantially parallel to said third rib.

10. An internal combustion engine, comprising:

a cylinder having a bore therein;

a cast cylinder head disposed adjacent to an end of said cylinder;

first and second spaced, cast ribs integrally formed with said cast cylinder head without machining;

a valve operating apparatus that operates an engine valve, comprising a rotatable cam shaft having at least one cam thereon;

a push rod that moves in response to said cam;

a rocker arm, having a longitudinal axis, that is pivoted in response to the movement of said push rod, said rocker arm having an aperture therein;

a fulcrum having a surface that engages said rocker arm and having a block portion that is received in said rocker arm aperture, said fulcrum block having two opposed, substantially flat sides that are received between said first and second ribs; and means for substantially immobilizing said fulcrum;

wherein said first rib forms an angle of about 0.5 to 5 degrees with a line that is at least one of normal and parallel to said longitudinal axis.

11. The internal combustion engine of claim 10, wherein said second rib is substantially parallel to said first rib.

12. The internal combustion engine of claim 10, wherein said fulcrum block portion is substantially shaped like a regular prism.

13. The internal combustion engine of claim 10, wherein said fulcrum includes an aperture, wherein said cylinder head includes an aperture, and wherein said immobilizing means includes a stud that is received in both said fulcrum aperture and in said cylinder head aperture.

14. The internal combustion engine of claim 13, further comprising:

a head cover disposed on said cylinder head, said cover having a cover aperture that receives said stud; and a fastener that fastens said stud to said head cover.

15. The internal combustion engine of claim 10, further comprising:

a mechanical lash adjuster interconnected with said rocker arm.

16. The internal combustion engine of claim 15, wherein said lash adjuster comprises:

a second aperture in said rocker arm;

an adjustment screw, disposed in said second aperture, that engages said push rod;

means for changing the position of said adjustment screw; and means for locking the position of said adjustment screw.

17. The internal combustion engine of claim 16, wherein said position changing means includes threads disposed on an outer surface of said adjustment screw, and wherein said locking means includes a lock nut that engages said screw threads.

* * * * *

UNITED STATES PATENT AND TRADEMARK OFFICE

CERTIFICATE OF CORRECTION

PATENT NO. : 5,645,025

DATED : July 8, 1997

INVENTOR(S) : Donald M. Caya et al.

It is certified that error appears in the above-indentified patent and that said Letters Patent is hereby corrected as shown below:

Column 6, line 20, after "intersected by" insert -- a --

Signed and Sealed this

Thirtieth Day of September, 1997

*Attest:*

*Attesting Officer*

BRUCE LEHMAN

*Commissioner of Patents and Trademarks*